US006488590B2

(12) United States Patent
Katayama

(10) Patent No.: US 6,488,590 B2
(45) Date of Patent: Dec. 3, 2002

(54) INDOOR SKIING GROUND FACILITIES HAVING LIGHTING FIXTURES

(75) Inventor: Minoru Katayama, Hiroshima (JP)

(73) Assignee: Kabushiki Kaisha Piste Snow Industries, Tokyo (JP)

( * ) Notice: Subject to any disclaimer, the term of this patent is extended or adjusted under 35 U.S.C. 154(b) by 0 days.

(21) Appl. No.: 09/802,366

(22) Filed: Mar. 9, 2001

(65) Prior Publication Data

US 2002/0128082 A1 Sep. 12, 2002

(51) Int. Cl.[7] ..... A63G 21/00
(52) U.S. Cl. ..... 472/90; 472/61; 434/247
(58) Field of Search ..... 472/61, 88, 90, 472/92; 434/247, 253, 38, 44

(56) References Cited

U.S. PATENT DOCUMENTS

| | | | | |
|---|---|---|---|---|
| 1,505,914 A | | 8/1924 | Witteborg | |
| 1,782,296 A | | 11/1930 | Goldstein | |
| 2,114,557 A | | 4/1938 | Davis | |
| 2,136,214 A | | 11/1938 | Keith | |
| 2,234,425 A | | 3/1941 | Brady | |
| 2,322,306 A | | 6/1943 | McLaren | |
| 2,609,992 A | | 9/1952 | Matthews | |
| 3,096,718 A | | 7/1963 | Anderson | |
| 3,250,530 A | * | 5/1966 | Dean et al. | 472/90 |
| 3,860,236 A | | 1/1975 | Buchanan | |
| 4,055,112 A | | 10/1977 | Larkfeldt | |
| 4,345,439 A | | 8/1982 | Gundlach | |
| 4,790,531 A | * | 12/1988 | Matsui et al. | 472/90 |
| 4,976,422 A | * | 12/1990 | Shimamura | 472/90 |
| 5,011,152 A | | 4/1991 | Hugunin | |
| 5,031,832 A | | 7/1991 | Ratnick et al. | |
| 5,230,218 A | * | 7/1993 | Clulow | 62/74 |
| 5,241,830 A | * | 9/1993 | Morioka et al. | 62/91 |
| 5,303,516 A | | 4/1994 | Delamare | |
| 5,327,738 A | * | 7/1994 | Morioka et al. | 62/74 |
| 5,331,991 A | | 7/1994 | Nilsson | |
| 5,482,510 A | * | 1/1996 | Ishii et al. | 472/61 |
| 6,079,161 A | * | 6/2000 | Tomioka et al. | 52/1 |

FOREIGN PATENT DOCUMENTS

| | | |
|---|---|---|
| JP | 62-270181 | 11/1987 |
| JP | 5-309158 | 12/1990 |
| JP | 5-135580 | 5/1992 |
| JP | 4-035664 | 6/1992 |
| JP | 6-051122 | 2/1994 |
| JP | 7-23964 | 9/1995 |
| JP | 11-22218 | 7/1997 |
| JP | 10-277199 | 10/1998 |
| JP | 11-319608 | 11/1999 |
| JP | 2996949 | 1/2000 |

* cited by examiner

*Primary Examiner*—Kien T. Nguyen
(74) *Attorney, Agent, or Firm*—Cummings & Lockwood

(57) ABSTRACT

In skiing ground facilities having a plurality of artificial snow manufacturing apparatuses of ice crushing type, this invention provides a system that is capable of precisely monitoring the respective artificial snow manufacturing apparatuses. This system comprises a monitoring apparatus, connected to the artificial snow manufacturing apparatus, for monitoring the operation state of each artificial snow manufacturing apparatus. This system has an outer monitoring apparatus, which is provided at an outer monitoring site positioned at a location away from the skiing ground, and is selectively connected to the monitoring apparatus provided at each skiing ground, whereby making it possible to monitor the operation state of each artificial manufacturing apparatus of each skiing ground.

10 Claims, 5 Drawing Sheets

II – II

INDOOR SKIING GROUND FACILITIES HAVING LIGHTING FIXTURES

BACKGROUND OF THE INVENTION

The present invention relates to indoor skiing ground facilities having a ski slope indoors, and particularly to an indoor skiing ground having various kinds of lighting fixtures.

In recent years, attention has focused on an indoor skiing ground as facilities that enable skiers to enjoy skiing regardless of seasons. The indoor skiing ground provides an artificial ski slope in the interior of a house whose temperature and humidity are controlled at given values. According to such an indoor skiing ground, the skiing ground can be constructed at the cities with no mountains, and skiers can enjoy skiing regardless of seasons as mentioned above.

Generally, the indoor skiing ground has difficulties in that skiers can not have the same expansive feeling as given by the natural skiing ground. Namely, in the indoor skiing ground, the ski slope is surrounded with the weal and roof in order to maintain the environment of snow (temperature, humidity and the like) around the ski slope, and there is no denying the fact that such indoor ski ground causes skiers to have a fixed cooped-up feeling.

As means for solving such a drawback, the provision of a retractable roof can be proposed. However, in such a skiing ground, there is a case that a large amount of cost is required for the construction and management. In the case of the fine weather, the roof can be opened, but must be closed in the cloudy or rainy days. The management of the opening and closing the roof and that of the change in the indoor temperature and the quality of snow resulting from the opening and closing the roof increase the cost.

SUMMARY OF THE INVENTION

The present invention has been made with consideration given to the above-mentioned problems, and an object of the present invention is to provide indoor skiing ground facilities that can implement a space where skiers can enjoy skiing more than the outdoor skiing ground.

Another object of the present invention is to provide indoor skiing ground facilities that enable skiers to have the same expansive feeling as given by the outdoor skiing ground by an inexpensive method.

In order to attain the above objects, according to a first aspect of the present invention, there is provided an indoor skiing ground comprising a ski slope with a predetermined inclination on which skiers go downhill;

a wall for surrounding the ski slope to cut off atmosphere on the ski slope from outer atmosphere; a plurality of spray nozzles, arranged at the inner side of the wall, for generating a plurality of screens of mist, each having a predetermined shape, at upper portions of the ski slope; and a plurality of projectors, arranged at the inner side of the wall, for projecting predetermined images on the screens of mist to be shown to the skiers.

According to the above structure, various images are projected on the screens of mist to produce a virtual space with many ideas to the skiing ground. This makes it possible to compensate for drawbacks of the indoor skiing ground in which the skiers cannot experience the same expansive feeling as given by the outdoor skiing ground, the change of weather, and so on, and to give more pleasant feelings to the skiers. Moreover, according to the above structure, since the images are projected on the screens of mist formed on the ski slope, it is possible to reduce occurrence of danger and give thrilling experience to the skiers appropriately.

According to one mode for carrying out this present invention, the plurality of spray nozzles may be continuously arranged along a predetermined direction to generate the curtain-like screens of mist. The spray nozzles are continuously arranged along a width direction of the ski slope to generate the curtain-like screens of mist extending along the width direction, and the spray nozzles are desirably arranged at given intervals in an inclination direction of the ski slope to form the curtain-like screens of mist in the inclination direction. In this case, the projectors are provided at given intervals along, the inclination direction of the ski slope to project the image on each of the plurality of screens of mist.

According to the above structure, since the images are projected on the curtain-like screens of mist formed, it is possible to show images with good viewability. This makes it possible to form the screens of mist at a plurality of positions and to project different images on the respective screens of mist.

According to the other mode for carrying out this present invention, the indoor skiing ground further comprises control means for selectively operating the plurality of spray nozzles and the plurality of the projectors wherein the control means controls the operation of the spray nozzles and the projectors in accordance with a control pattern prepared depending on a predetermined scene. At this time, the control means desirably operates the spray nozzles or the projectors, or both in synchronization with downhill speed of the skiers.

According to the above structure, the screens of mist can be concurrently generated at the different locations of the ski slope and they may be shifted and generated. Also, the decision of spray time makes it possible to minimize deterioration in the quality of snow caused by the spray. The operation of the spray nozzles or the projectors, or both is controlled in synchronization with downhill speed of the skiers, whereby making it possible to produce the scene where, for example, the skier chases the image of the helicopter.

According to a second aspect of the present invention, there is provided an indoor skiing ground comprising a ski slope with a predetermined inclination on which skiers go downhill; and a wall for surrounding the ski slope to cut off atmosphere on the ski slope from outer atmosphere, wherein the inner surface of the wall that surrounds the ski slope is formed to have a semicircular shape extending from one side portion to the other side portion, and a landscape that imitates sky is painted on the inner surface.

According to the above structure, the semicircular wall that extends from one side portion to the other side portion makes it possible to prevent a shadow from being generated at the time of illuminating landscapes and to implement scenery with depth. This makes it possible to give the skiers virtual reality as if they were in the outdoor skiing ground though this is the low-cost method.

According to one mode for carrying out this invention, the indoor skiing ground further comprises illuminators for illuminating the landscape on the inner surface of the wall and illuminators for illuminating the surface of the ski slope, separately.

According to the above structure, the landscape can be more efficiently illuminated.

According to one mode for carrying out this present invention, the landscape painted on the inner surface of the wall includes objects painted with fluorescent paint, the illuminators for illuminating the landscape are provided such that normal light and near-ultraviolet light for emitting the objects painted with fluorescent paint are changeable.

According to the above structure, painting, e.g., stars with fluorescent paint, makes it possible to implement the scene of stars in the night sky.

According to the other mode for carrying out this present invention, the illuminators for illuminating the surface of the ski slope include illuminators for daytime, which are used together with normal light with which the landscape is illuminated at the time of representing daytime, and illuminators for night, which are used in a state in which the normal light is turned off or weakened at the time of representing night.

According to the above structure, the use of illuminators for night can give the skiers the virtual reality as if they were skiing downhill outdoors at night.

BRIEF DESCRIPTION OF THE SEVERAL VIEWS OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

A preferred embodiment of the present invention will be specifically described with reference to the accompanying drawings.

Figure 1:
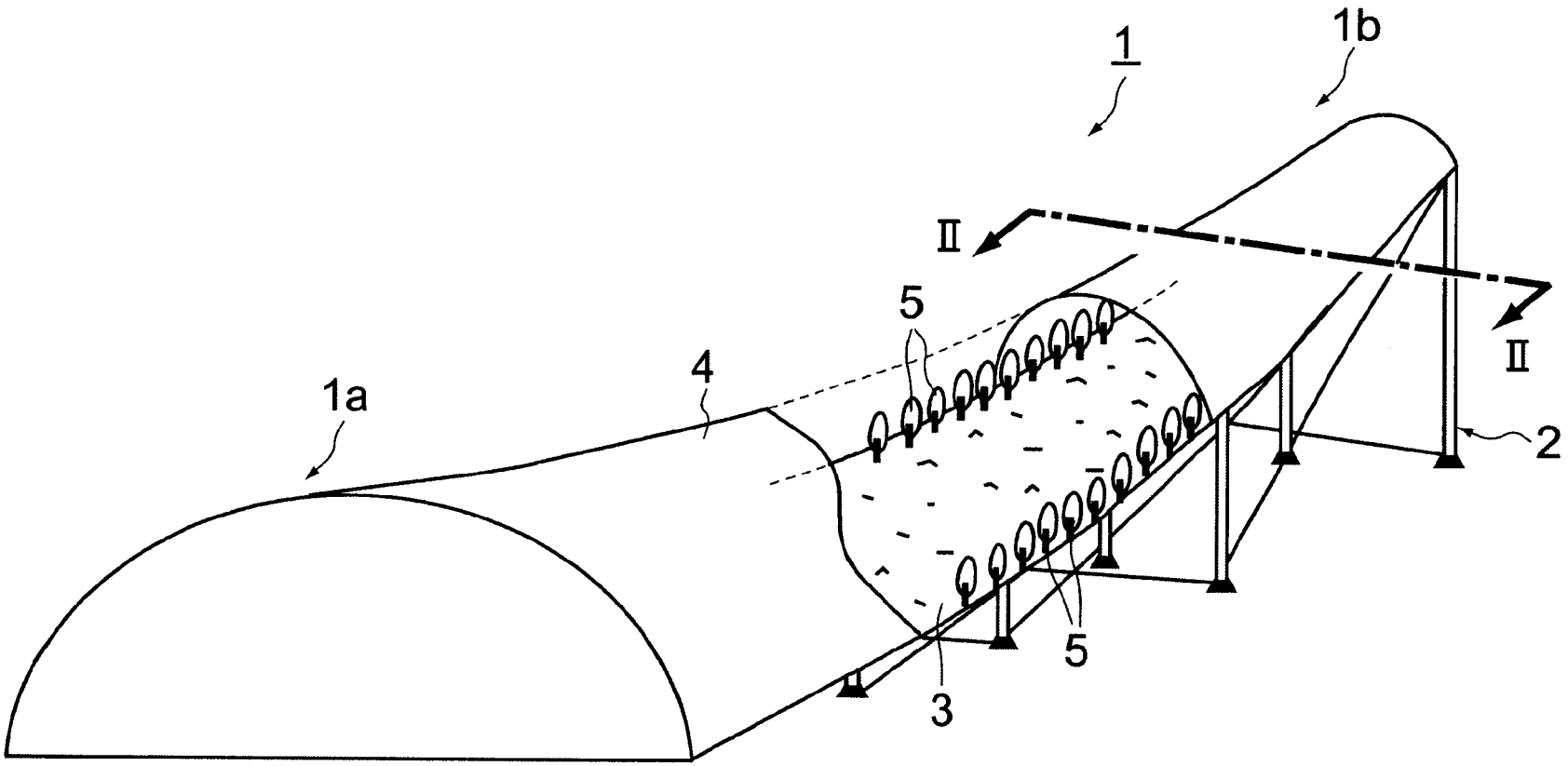
FIG. 1 is a perspective view with a partial cross-section illustrating a general configuration of an indoor skiing ground.

FIG. 1 is a perspective view with a partial cross-section illustrating a general configuration of an indoor skiing ground.

An indoor skiing ground 1 is composed of mainly an artificial ski slope 3, which is supported to have a given inclination by a support structural member 2, and a semicircular ceiling section 4, which covers the ski slope 3 to maintain the surroundings thereof in a predetermined atmosphere. In this figure, a left side on the paper indicates a foot side 1*a* and a right side on the paper indicates a top side 1*b*, and the ski slope 3 is formed to be gradually wider along a direction to the foot 1*a* from the top 1*b*.

As illustrated in FIG. 1 where the ceiling section 4 is partially cut, snow manufactured by an artificial snow-manufacturing machine (not shown) is supplied onto the ski slope 3, and the surface is packed and leveled for skiing downhill. The interior of the skiing ground 1 is controlled by an air conditioner (not shown) such that temperature and humidity are controlled to be the atmosphere in which snow on the ski slope 3 can be maintained to be a suitable state. It is noted that natural or artificial plants 5 are arranged along both sides at regular intervals.

Figure 2:
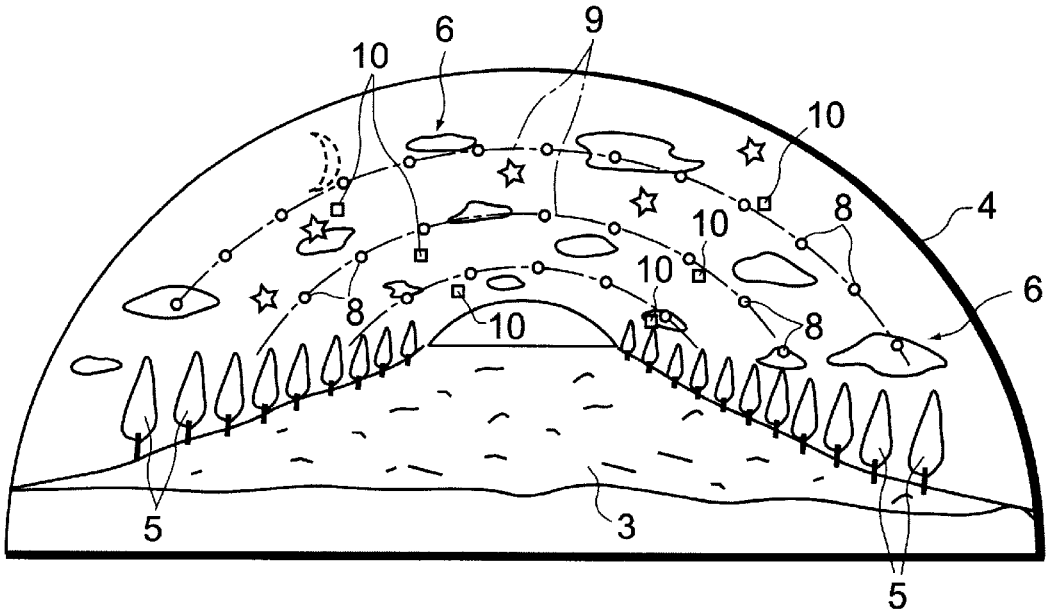
FIG. 2 is a longitudinal cross-sectional view taken along a line of II—II of FIG. 1.

FIG. 2 is a longitudinal cross-sectional view taken along a line of II—II of FIG. 1. In FIG. 2, the front side on the paper is the top side of the ski slope 3 and the inner side of the paper is the foot side. As illustrated in this figure, on the inner surface of the semicircular ceiling section 4, landscapes 6 such as sky, clouds, stars, and so on are painted with normal paint or fluorescent paint over the entire surface. Then, the landscapes 6 are illuminated by means to be explained later, whereby making it possible to implement virtual reality that gives the skiers a feeling as if this skiing ground existed outdoors.

Moreover, on the inner surface of the semicircular ceiling section 4, a plurality of spray nozzles 8 is arranged at positions indicated by a mark "○" in FIG. 2. These spray nozzles 8 extend in a direction perpendicular to the downhill direction of the ski slope 3 and are arranged along a plurality of lines 9 provided at regular intervals along the downhill direction. Then, water is sprayed from the respective spray nozzles 8, whereby making it possible to form curtain-like mist films, which are patterned after the shape of lines 9. Projectors 10 are also arranged at positions indicated by a mark "■" in FIG. 2 to project images on the screens of mist formed by the spray nozzles 8.

Figure 3A:
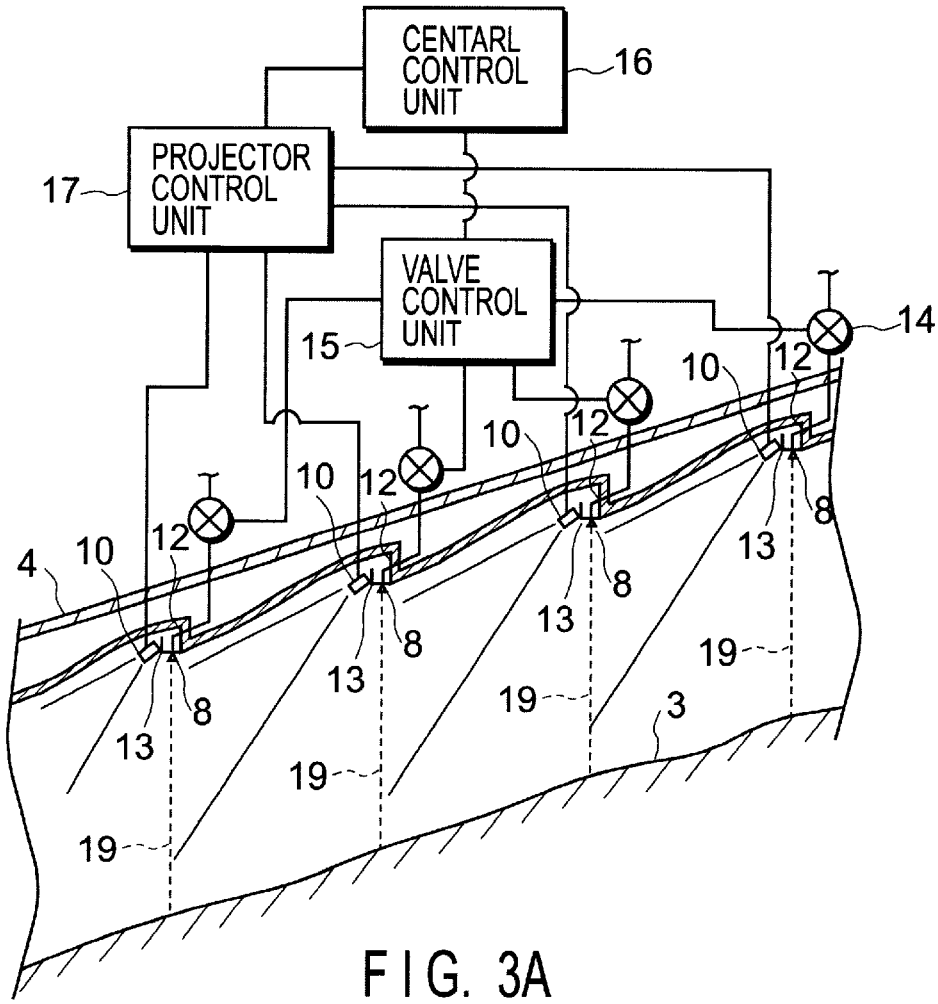
FIG. 3A is a schematic view illustrating a state where the indoor skiing ground is cut along a downhill direction of a ski slope, and a control system for spray nozzles and projectors.

FIG. 3A is a schematic view illustrating a state where the ceiling section 4 is cut along the downhill direction of the ski slope 3. The ceiling section 4 has steps indicated by reference numeral 12 along the respective lines 9 of FIG. 2. A passage 13 with a handrail where a worker can pass is formed at the edge of each step 12. Each spray nozzle 8 is fixed to the lower face of the passage 13 and each projector 10 is fixed to the handrail of the passage 13.

Each spray nozzle 8 is connected to a water supply source (not shown) through a control valve 14, and the control valve 14 is connected to a central controller 16 through a valve control unit 15. Each projector 10 is connected to the central controller 16 through a projector control unit 17.

Figure 3B:
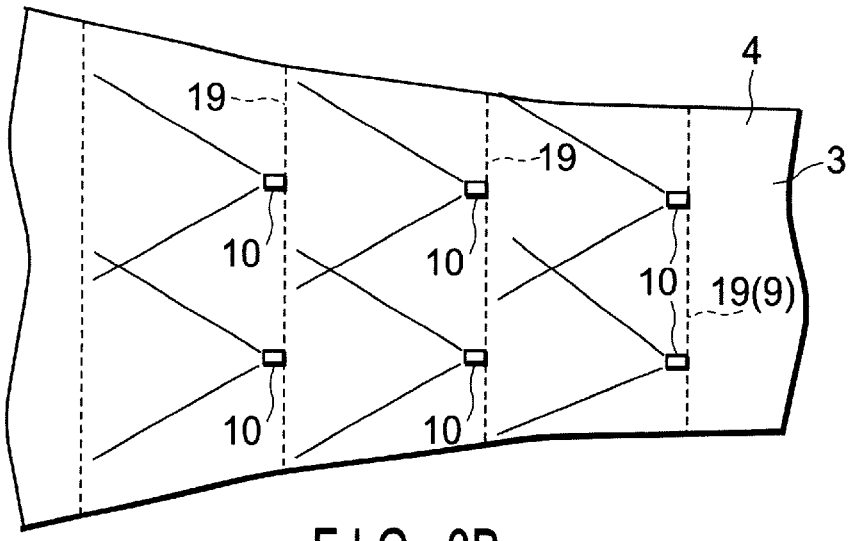
FIG. 3B is a plane view of FIG. 3A.

This configuration makes it possible for the respective spray nozzles 8 to form the screens of mist indicated by reference numeral 19 in FIGS. 3A and 3B along the siding direction of the ski slope 3 at regular intervals. This configuration also makes it possible for the respective projectors 10 to project predetermined images on the screens of mist 19 formed at the lower side in the downhill direction of the ski slope.

Figure 4:
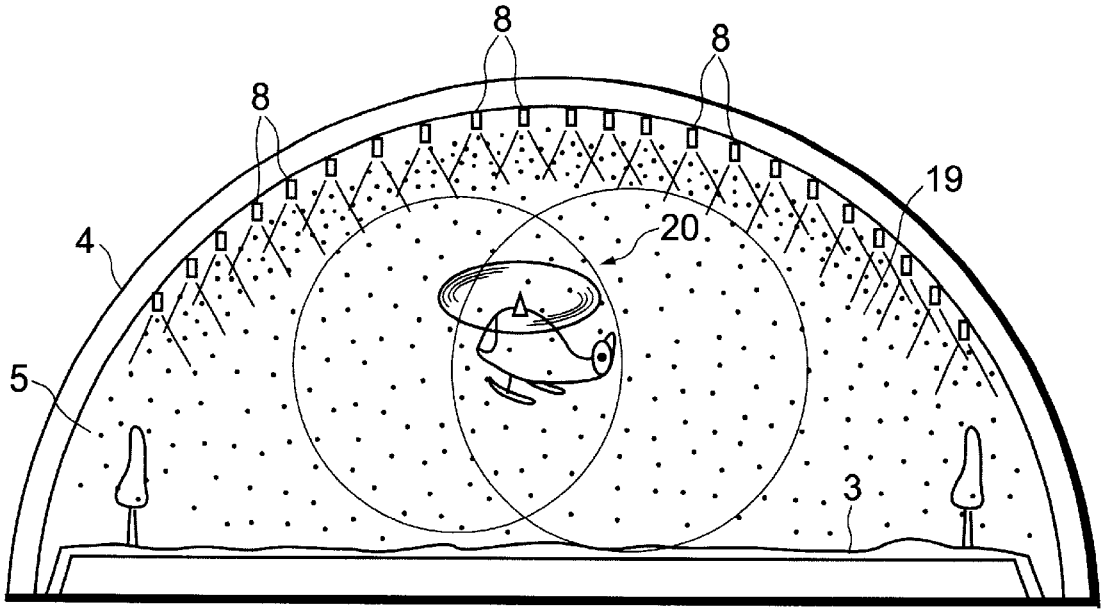
FIG. 4 is a view illustrating a state in which an image of a helicopter is projected on a screen of mist.

As illustrated in FIG. 3, for example, two projectors are attached to predetermined positions along the line 9 (screen of mist 19). Thus, the use of two projectors 10 makes it possible to implement a three-dimensional image. FIG. 4 illustrates an example in which an image 20 of a helicopter is projected on the screen 19 three-dimensionally by two projectors 10. This makes it possible for the skiers to ski while viewing the three-dimensional image, The skiers can view the image projected on the next screen of mist 19 when passing through one screen of mist 19.

According to this embodiment, the image 20 projected on each screen of mist 19 is synchronized with the downhill speed of the skier to produce various scenes by the configuration explained later. For example, in the example of FIG. 4, it is possible to produce such a scene that the image of 20 of helicopter comes near the skier or moves away from the skier. As a result, the skier can enjoy skiing as if they were experiencing an atmosphere of competition with the helicopter.

Figure 5:
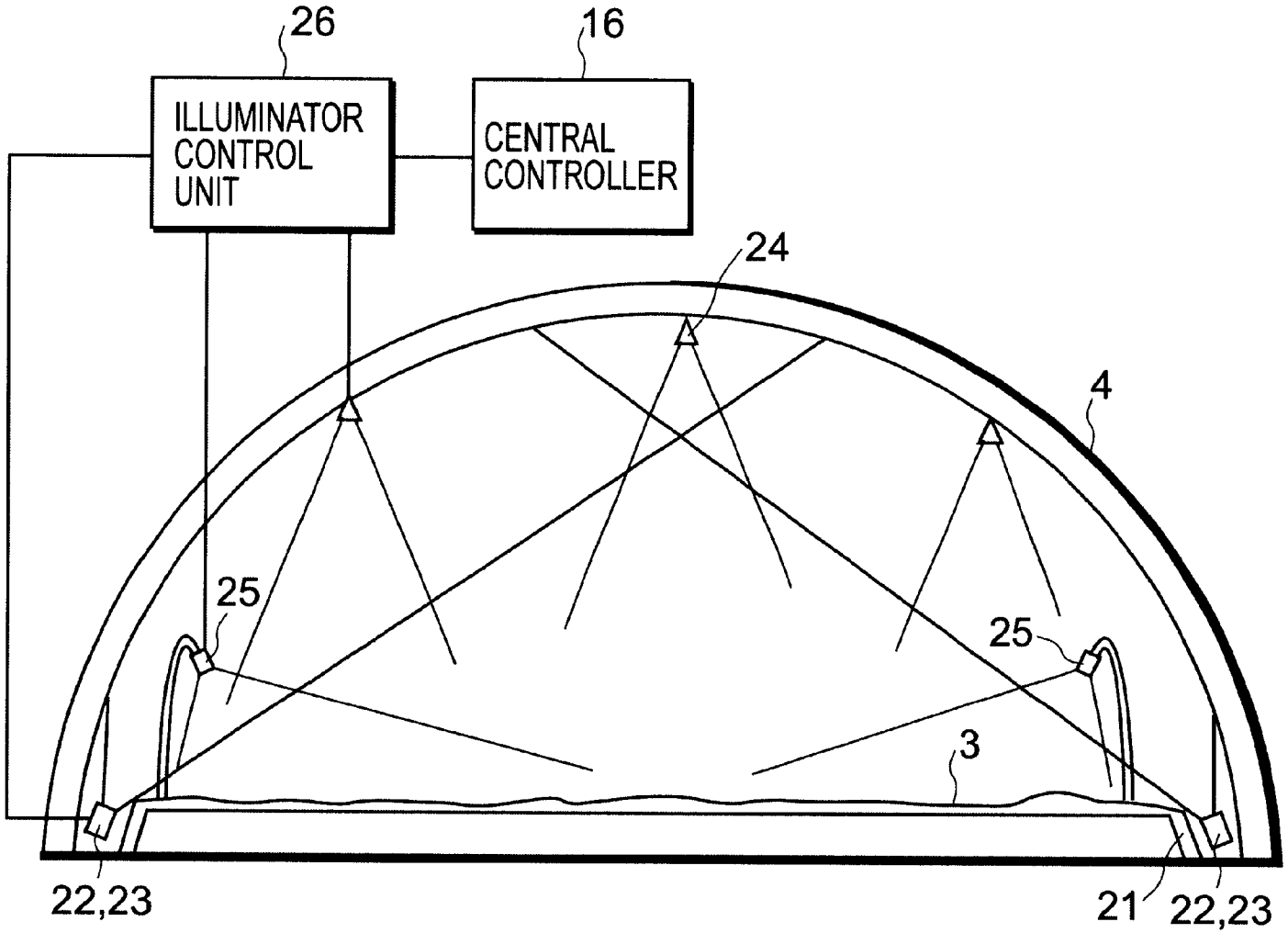
FIG. 5 is a front view illustrating the arrangement of illuminators.

FIG. 5 is a front view illustrating the method of illumination with respect to the ceiling section 4 and the ski slope 3. In this example, a first illuminator 22 and a second illuminator 23 are arranged at a groove portion 21 formed at each side of the ski slope 3 with a given angle. The ceiling section 4 is illuminated with normal light from the first illuminator 22. The ceiling surface is illuminated with near-ultraviolet light from the second illuminator 23. This makes it possible to illuminate the entire surface of the ceiling section 4 with normal light or near-ultraviolet light.

Additionally, third illuminators 24 are arranged at the ceiling section 4 to illuminate the ski slope 3 with direct light Fourth illuminators 25 are arranged at both sides of the ski slope 3 to allow night illumination of the ski slope surface. Then, the first to fourth illuminators 22 to 25 are connected to die central controller 16 through an illumination control unit 26.

Figure 6:
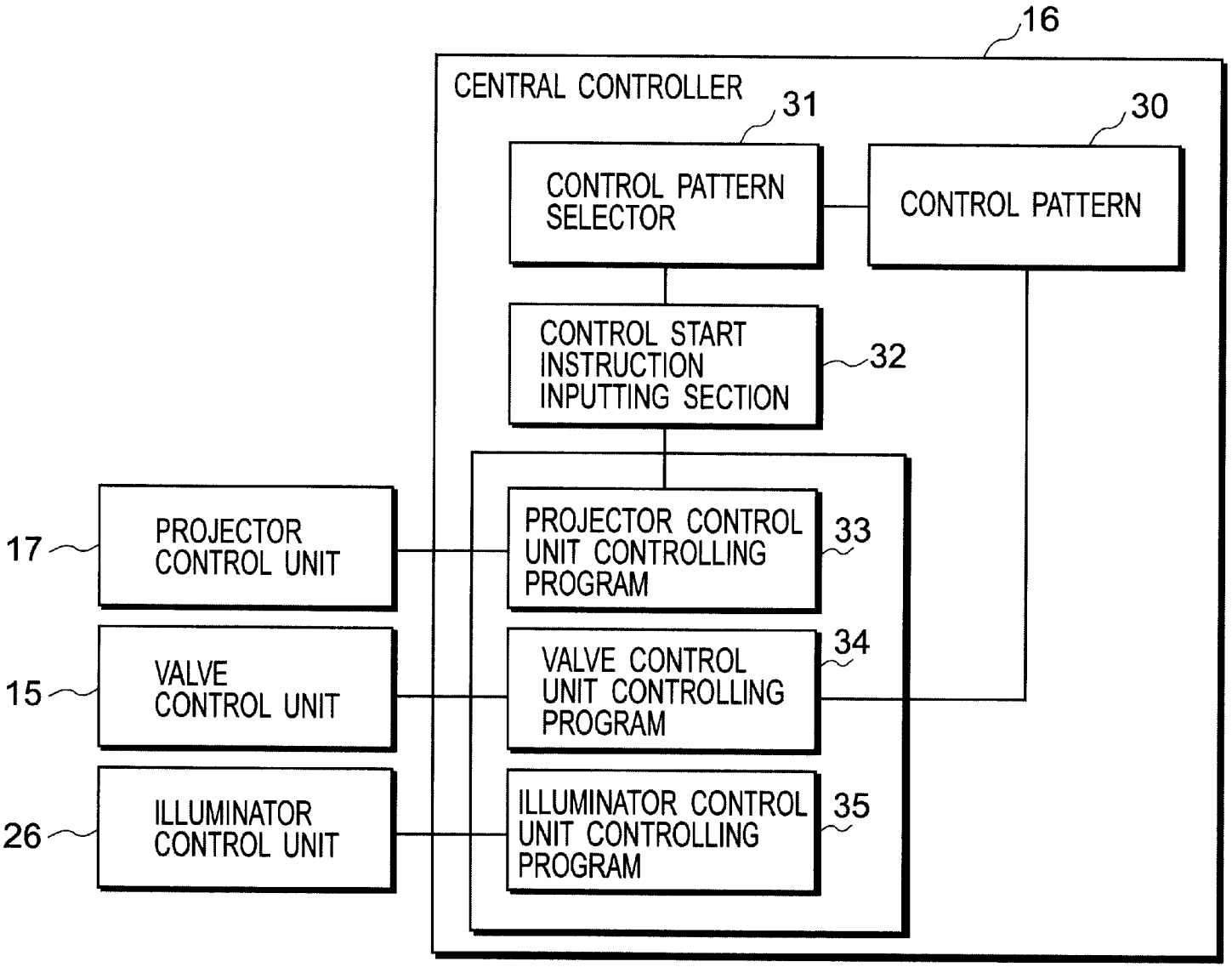
FIG. 6 is a block diagram illustrating the configuration of a central controller illustrated in FIGS. 3A and 5.

An explanation is next given of the configuration of the central controller 16 that controls the spray nozzles 8, projectors 10, first to fourth projectors 22 to 25 and the scenes at the indoor skiing ground with reference to FIG. 6

The central controller 16 has a control pattern storage 30 that stores the control patterns of the spray nozzles 8, projectors 10, and first to fourth projectors 22 to 25. The respective patterns define operation timing at a start time, projecting images, intensity of illumination, colors, and the like with respect to the control patterns of the spray nozzles 8, projectors 10, and first to fourth projectors 22 to 25S. They are prepared in advance depending on the kinds of scenes.

The central controller 16 comprises a control pattern selector 31 and a start instruction input section 32. The control pattern selector 31 selects one control pattern from the control pattern storage 30. The start instruction input section 32 starts control in accordance with the selected control pattern. The central controller 16 further comprises a program 33 for controlling the projector control unit 17 in accordance with the selected control pattern, a program 34 for controlling the valve control unit 15, and a program 35 for controlling the illuminator control unit 26.

These components of the central controller 16 are actually computer software programs that are stored in a predetermined storage area or a part of the storage area, which are reserved in a hard disk and a ROM of the computer system. Then, they are appropriately accessed on a RAM by a CPU (not shown) and executed, whereby bringing about the function of this embodiment.

The following will explain the examples of performance control with the aforementioned configuration.

① Scene of Daytime

In order to produce the scene of daytime, only first and third illuminators 22 and 24 are actuated. Namely, the landscapes 6 on the ceiling section are illuminated with light from the first illuminators 22 to produce the sky of the daytime. The ski slope 3 is illuminated with light from the third laminators 24 to provide sufficient light.

② Scene of Night

In order to produce the scene of night, second and fourth illuminators 23 and 25 are actuated. Namely, the first and third illuminators 22 and 24 are turned off to darken the interior of the skiing ground, and the fourth illuminators 25 are actuated to produce an atmosphere of night illumination. On the other hand, the landscapes 6 such as stars, the moon, and the like painted on the ceiling section 4 with fluorescent paint are illuminated with light from the second illuminators 23, whereby emitting only the landscapes 6.

At this time, the production of aurora by actuating the spray nozzles 8 and the projectors 10 is effective. In the case of producing aurora, precise control of the spray nozzles 8 (control valve 15) is effective. According to this embodiment, the control value 15 is connected to each of all nozzles 8 formed along the lines. The control valve 15 connected to the desired nozzle 8 is selectively opened/closed to form the screen of mist 19 on only the part of the lines 9. This makes it possible to produce a scene in which the aurora is flickering.

③ Scene of Snow

The scene of snow is produced independently of the scene of daytime and the scene of night.

In this case, the spray nozzles 8 are actuated to form the screen of mist 19, while the projectors 10 are actuated to project a moving image of snow falling on the surface of the screen of mist 19.

④ Competition with a Helicopter

The scene of the helicopter is also produced independently of the scene of daytime and the scene of night.

In this case, the spray nozzles 8 are actuated to form the screen of mist 19, while the projectors 10 are actuated to project a moving image of the helicopter on the surface of the screen of mist as illustrated in FIG. 4. Then, the plurality of projectors and the spray nozzles are controlled in accordance with the downhill speed of the skier, whereby producing the scene as if the skier and the helicopter were competing with each other.

At this time, the control pattern selector 31 and the start instruction input section 32 may be operated by the operation worker. Or, they may be operated by skiers at cost or free. In the latter case, a request input apparatus is preferably installed at the position close to the top of the ski slope 3 such that the skier can request a scene. This operation is preferably structured such that the control pattern selector 31 and the start instruction input section 32 are actuated when the skier operates this apparatus.

According to the aforementioned structure, there can be obtain the indoor skiing ground facilities that make it possible to have the same expansive feeling as given by the outdoor skiing ground by use of virtual reality and to produce various recreational scenes.

In the above-mentioned indoor skiing ground, the ceiling section 4 is semicircularly formed such that the inner surface thereof is rounded to the side portion of the ski slope. This makes it possible to prevent a shadow from being generated at the time of illuminating landscapes 6 and to implement scenery with depth. Moreover, the step 12 where the projector 10 is provided is formed such that the step surface appears in the direction of the slope lower side. As a result, the step surface cannot be seen by the skier who skies on the downhill surface. This makes it possible to extremely reduce sense of incongruity given to the skier.

The present invention is not limited to the above-mentioned embodiment and various modifications may be made without departing from the broad spirit and scope of the invention.

For example, the lines are not limited to the straight lines. Wavelike lines maybe used. In addition, lines with different shapes may be prepared at the same position and the spray nozzles maybe arranged on the lines respectively. In this case, the change of line allows various shapes of screens of mist to be formed.

In the aforementioned embodiment, there is no denying the fact that a long-duration spray from a specific line or spray nozzle may exert an adverse influence upon the quality of snow just below the line or spray nozzle. For this reason, the line or spray nozzle is desirably changed at regular intervals to prevent the long-duration spray onto only one location.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

What is claimed is:

1. An indoor skiing ground comprising:

a ski slope with a predetermined inclination on which skiers go downhill;

a wall for surrounding said ski slope to cut off atmosphere on said ski slope from outer atmosphere;

a plurality of spray nozzles, arranged at the inner side of said wall, for generating a plurality of screens of mist, each having a predetermined shape, at upper portions of said ski slope; and a plurality of projectors, arranged at the inner side of said wall, for projecting predetermined images on said screens of mist to be shown to said skiers.

2. The indoor skiing ground according to claim 1, wherein said plurality of spray nozzles are continuously arranged along a predetermined direction to generate the curtain-like screens of mist.

3. The indoor skiing ground according to claim 2, wherein said spray nozzles are continuously arranged along a width direction of said ski slope to generate the curtain-like screens of mist extending along said width direction, and said spray nozzles are arranged at given intervals in a downhill direction of said ski slope to form said curtain-like screens of mist in said inclination direction.

4. The indoor skiing ground according to claim 3, wherein said projectors are provided at given intervals along the inclination direction of said ski slope to project said image on each of said plurality of curtain-like screens of mist.

5. The indoor skiing ground according to claim 4, further comprising control means for selectively operating said plurality of spray nozzles and said plurality of said projectors, wherein said control means operates said spray nozzles and said projectors in accordance with a control pattern prepared depending on a predetermined scene.

6. The indoor skiing ground according to claim 5, wherein said control means controls the operation of said spray nozzles or said projectors, or both in synchronization with downhill speed of the skiers.

7. The indoor skiing ground according to claim 1, wherein the inner surface of said wall that surrounds said ski slope is formed to have a semicircular shape extending from one side portion to the other side portion, and a landscape that imitates sky is painted on the inner surface.

8. The indoor skiing ground according to claim 7, further comprising illuminators for illuminating the landscape on the inner surface of the wall and illuminators for illuminating the surface of the ski slope, separately.

9. The indoor skiing ground according to claim 8, wherein the landscape painted on the inner surface of said wall includes objects painted with fluorescent paint, said illuminators for illuminating said landscape are provided such that normal light and near-ultraviolet light for emitting the objects painted with fluorescent paint are changeable.

10. The indoor skiing ground according to claim 8, wherein said illuminators for illuminating the surface of said ski slope includes illuminators for daytime, which are used together with normal light with which said landscape is illuminated at the time of representing daytime, and illuminators for night, which are used in a state in which said normal light is turned off or weakened at the time of representing night.

* * * * *